US008753299B1

(12) United States Patent
Waldon, Sr.

(10) Patent No.: US 8,753,299 B1
(45) Date of Patent: Jun. 17, 2014

(54) THERAPEUTIC JOINT COVER APPARATUS

(71) Applicant: Lester N. Waldon, Sr., Kissimmee, FL (US)

(72) Inventor: Lester N. Waldon, Sr., Kissimmee, FL (US)

( * ) Notice: Subject to any disclaimer, the term of this patent is extended or adjusted under 35 U.S.C. 154(b) by 0 days.

(21) Appl. No.: 13/952,860

(22) Filed: Jul. 29, 2013

Related U.S. Application Data

(63) Continuation of application No. 13/653,241, filed on Oct. 16, 2012, now Pat. No. 8,523,793, which is a continuation-in-part of application No. 12/433,594, filed on Apr. 30, 2009, now abandoned.

(51) Int. Cl.
*A61H 1/00* (2006.01)

(52) U.S. Cl.
USPC ..... 601/46; 601/84; 601/87

(58) Field of Classification Search
USPC ..... 601/15, 46, 84, 87; 602/16, 23, 26, 602/60–63; 128/882
See application file for complete search history.

(56) References Cited

U.S. PATENT DOCUMENTS

| | | | | |
|---|---|---|---|---|
| 1,915,721 | A * | 6/1933 | Diaz | 361/232 |
| 4,732,140 | A | 3/1988 | Stoffregen | |
| 5,221,252 | A | 6/1993 | Caprio, Jr. et al. | |
| 5,334,131 | A | 8/1994 | Omandam et al. | |
| 5,540,964 | A * | 7/1996 | Mallen | 428/36.1 |
| 6,273,866 | B2 | 8/2001 | Thomas et al. | |
| 2008/0125688 | A1 * | 5/2008 | Kellogg et al. | 602/61 |
| 2009/0221943 | A1 * | 9/2009 | Burbank et al. | 601/46 |

* cited by examiner

*Primary Examiner* — Michael A. Brown
(74) *Attorney, Agent, or Firm* — McKee, Voorhees & Sease, P.L.C.

(57) ABSTRACT

A therapeutic joint cover apparatus for massaging a knee while also providing compression that includes a tapered support body having an oval cutout centrally disposed therein which is surrounded by vibrating motors. A trio of length adjustable straps engages respective rings on the opposite side of the support body and a hook portion of hook and loop fastener disposed the straps' outer ends removably attach to an outer side of the support body to secure the support body to a user's knee. An interior lining disposed on the support body inner side provides a cool comfortable fit between the vibrating nodes and the user's knee. The apparatus is self-contained, including an on-off pressure-switched rechargeable battery housed in a pocket proximal to the top end so that no assembly or other preparations are required.

4 Claims, 4 Drawing Sheets

THERAPEUTIC JOINT COVER APPARATUS

CROSS-REFERENCE TO RELATED APPLICATIONS

This application is a Continuation of application U.S. Ser. No. 13/653,241 filed Oct. 16, 2012, which is a Continuation-in-Part of U.S. Ser. No. 12/433,594 filed filed Apr. 30, 2009, herein incorporated by reference in their entirety.

BACKGROUND OF THE INVENTION

The benefits of massage therapy for many body parts are well known. Massage therapy for knees, however, is not a well-known art and is often difficult due to tissue access issues, sensitivity of the knee area, and soreness in the knee muscles and joints. Additionally, daily or even more frequent massage and treatment for the knees can be associated with inconvenience and significant expense. As is well understood, compression plays a vital role in knee therapy. The present apparatus addresses the foregoing issues by providing a self-contained apparatus including an elastomeric support body that surrounds the front of the knee, elastomeric straps that secure the support body to the knee while promoting compression, an oval cutout centrally disposed in the support body to accommodate the protruding bones of the knee cap in order to avoid compression thereof, and spaced apart vibrating nodes disposed around the oval cutout to promote circulation.

The combined compression and circulation order to avoid compression thereof, and spaced apart vibrating nodes disposed around the oval cutout to promote circulation.

The combined compression and circulation promotion provides self-contained modalities not heretofore available to those needing knee massage therapy.

FIELD OF THE INVENTION

The therapeutic joint cover apparatus relates to therapeutic modalities for body joints and more especially to adjustably fitted elasticized knee joint cover with strategically disposed spaced apart vibrating nodes.

SUMMARY OF THE INVENTION

The general purpose of the therapeutic joint cover apparatus, described subsequently in greater detail, is to provide a therapeutic joint cover apparatus which has many novel features that result in an improved therapeutic joint cover apparatus which is not anticipated, rendered obvious, suggested, or even implied by prior art, either alone or in combination thereof.

To attain this, the therapeutic joint cover apparatus provides a self-administered therapeutic massaging device for a user's right and left knees. The present apparatus provides compression of the knee joint and thereby alleviates and prevents swelling. Strategically located vibrating motors, which are disposed within the inner side of a support body, massage muscles and connective tissue around the knee joint, thereby treating injury, preventing further injury, and soothing pain and irritation. The support body has a gradually tapered width with a top end of the support body being wider than a bottom end thereof. An oval cutout is centrally disposed in the support body to accommodate the protruding bones of the knee cap in order to avoid compression thereof. Two elongated elastomeric upper and lower straps and one elastomeric center strap extend from a right side of the support body to conform the support body to the knee. A plurality of rings is disposed on a left side of the support body in alignment with the straps to permit the straps to engage the ring for adjustment of the straps' lengths. A length of hook and loop fastener is disposed at an outer end of each of the straps to allow the outer end to be removably secured to the outer side of the support body. An interior lining disposed on the inner side of the support body provides a cool comfortable fit between the vibrating nodes and the user's knee. The apparatus is self-contained, including an on-off pressure-switched rechargeable battery housed in a pocket proximal the top end, so that no assembly or other preparations are required. The pocket for the battery is sized to provide ample room for accessibility to the battery for recharging the battery. For the purposes of the description of the present apparatus, the terms "right side" and "left side" are interchangeable and are not to be regarded as limiting.

The therapeutic joint cover apparatus allows complete freedom of movement during therapy because the apparatus can be operated with the charge port plugged in or unplugged. The apparatus is easily adjustably fitted to a wide range of knee sizes. Lightweight neoprene preferably forms for the support body and the straps to ensure breathability and to reduce heat against a user's knee when the apparatus is worn. The interior lining is preferably formed of Lycra™ to prevent exposure to wiring between the battery and the vibrating motors while providing the cool comfortable fit between the vibrating motors and the user's knee.

Thus has been broadly outlined the more important features of the improved therapeutic joint cover apparatus so that the detailed description thereof that follows may be better understood and in order that the present contribution to the art may be better appreciated.

DETAILED DESCRIPTION OF THE PREFERRED EMBODIMENTS

Figure 1:
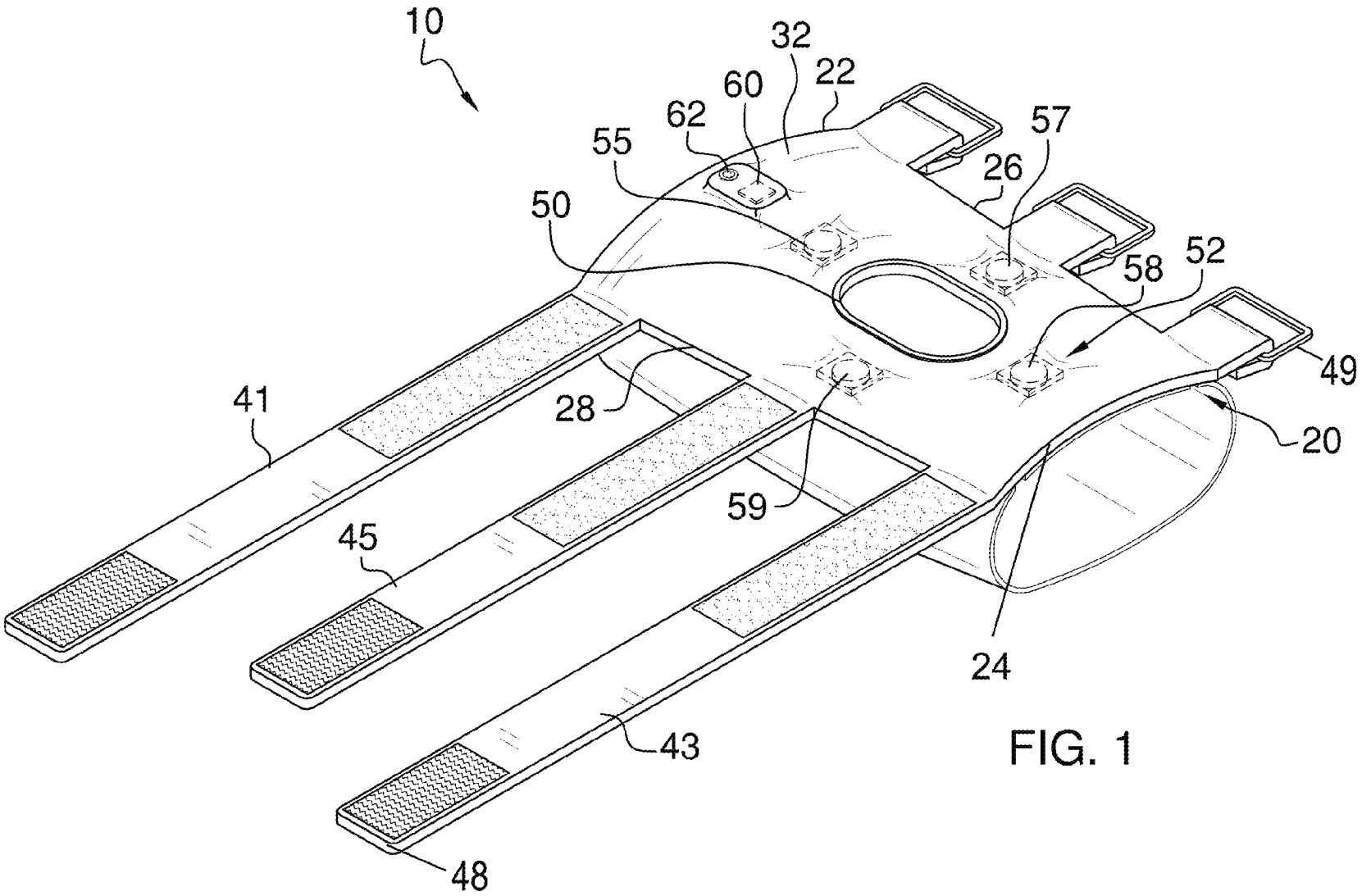
FIG. 1 is an outer side perspective view.
Figure 2:
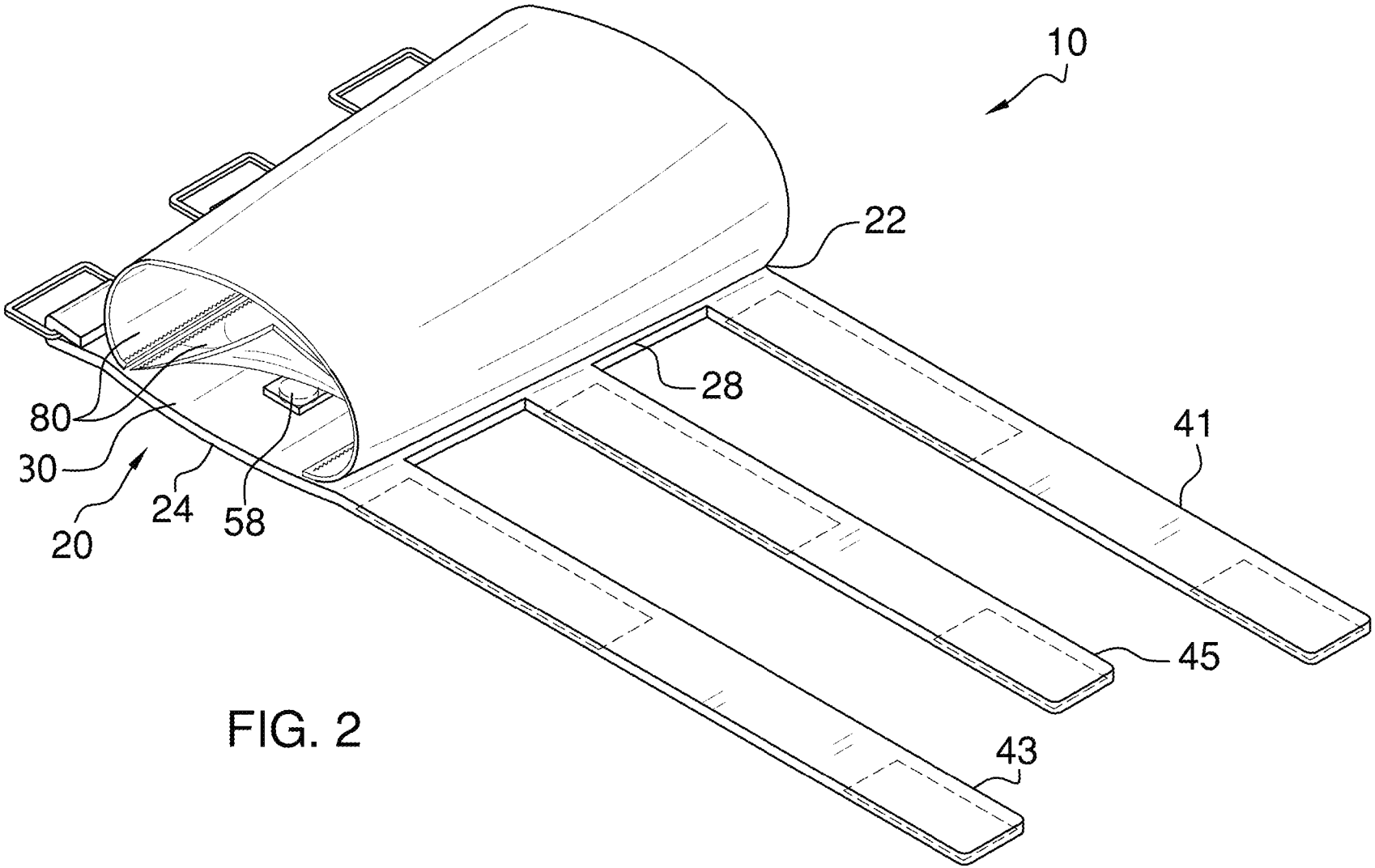
FIG. 2 is an inner side perspective view.
Figure 3:
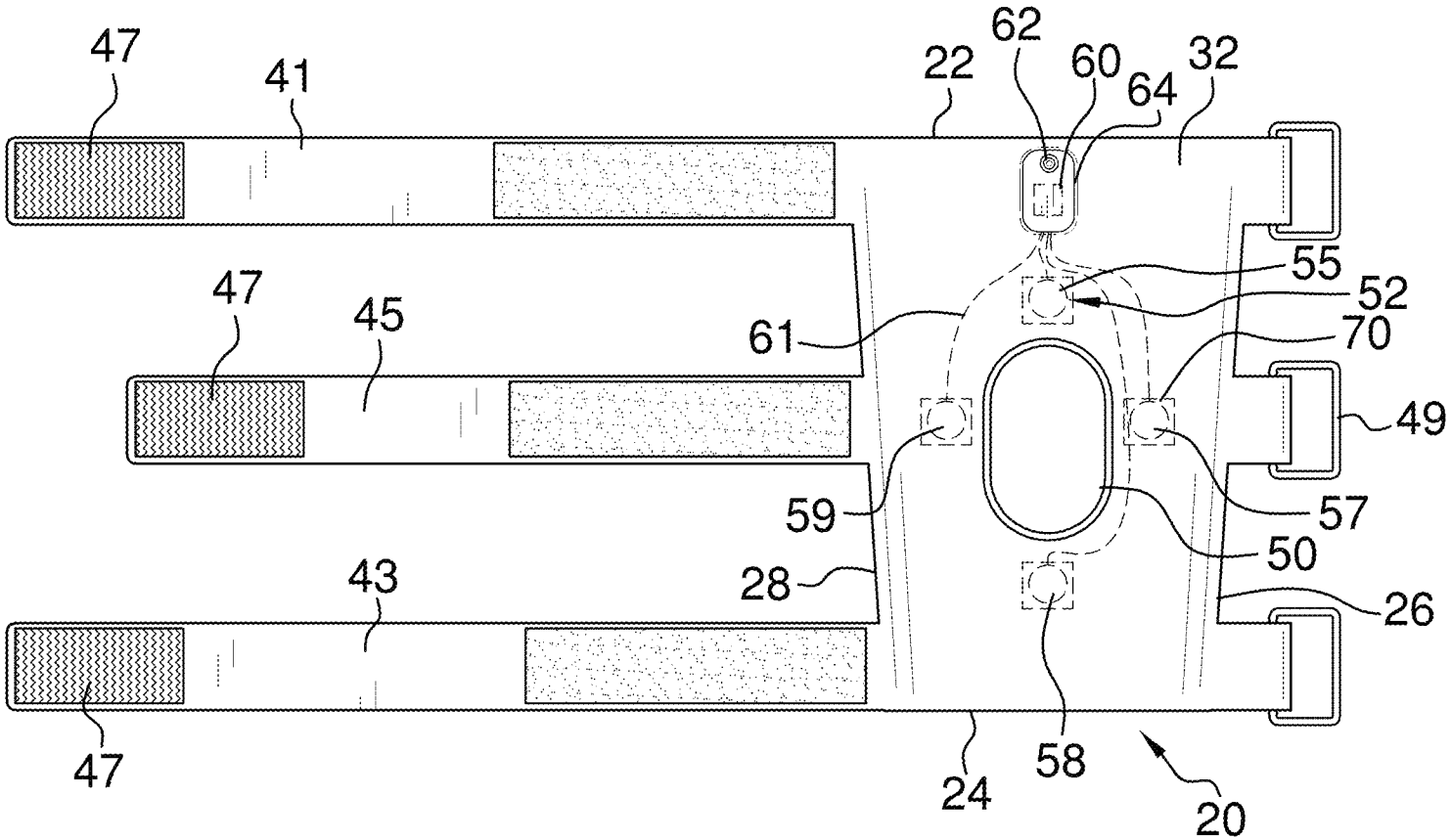
FIG. 3 is an outer side elevation view.
Figure 4:
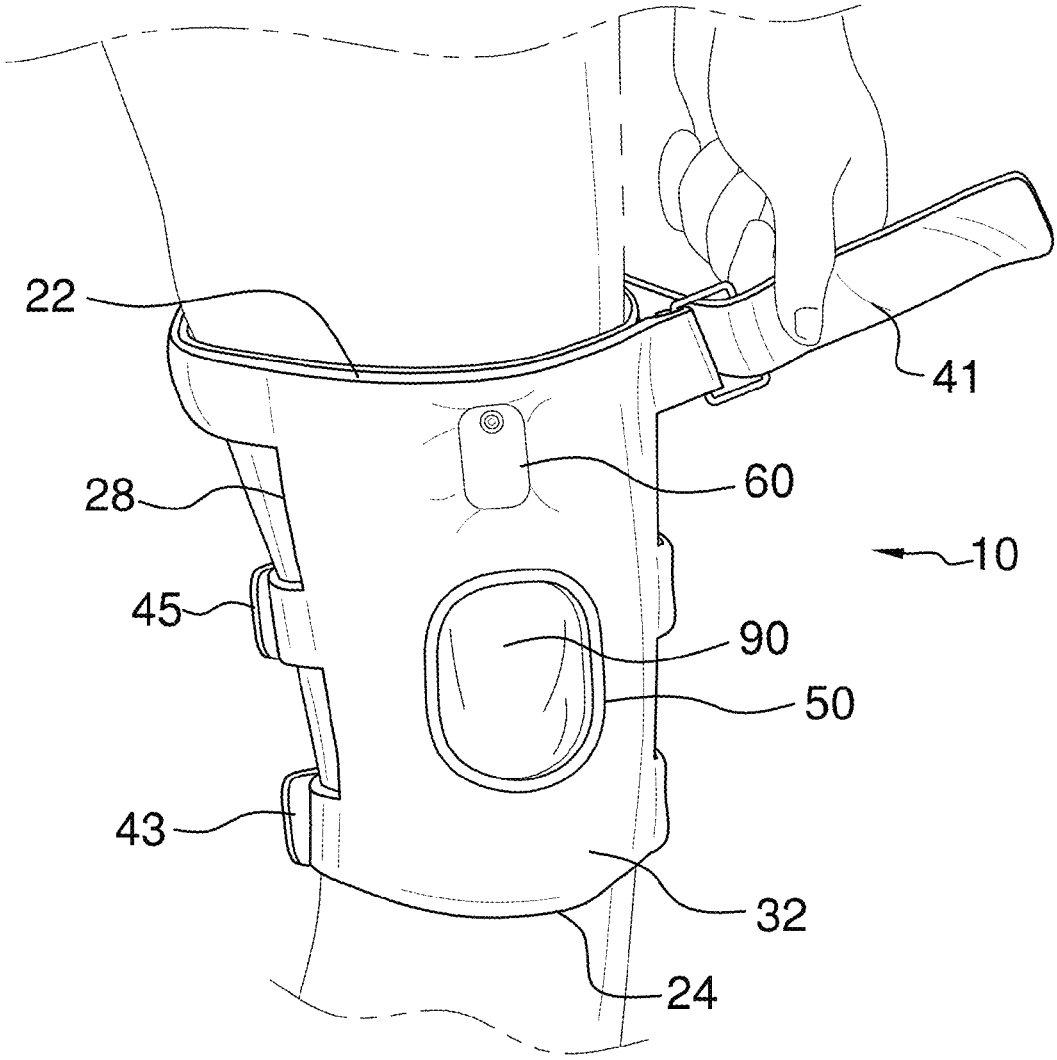
FIG. 4 is a perspective in-use view.

With reference now to the drawings, and in particular FIGS. 1 through 4 thereof, the principles and concepts of the therapeutic joint cover apparatus generally designated by the reference number 10 will be described.

As illustrated in FIGS. 1 through 4, the instant apparatus 10 comprises an elastomeric support body 20 having a top end 22 spaced apart from a bottom end 24, a right side 26 spaced apart from a left side 28, and an inner side 30 disposed opposite an outer side 32. The support body 20 has a gradually tapered width with the top end 22 being wider than the bottom end 24 to conform to the general structure of a leg proximal to a knee.

An elastomeric upper strap 41 extends from the left side 28 at the top end 22 in a position parallel to the top end 22. An elastomeric lower strap 43 extends from the left side 28 at the bottom end 24 in a position parallel to the bottom end 24. An elastomeric center strap 45 is centrally disposed between the upper strap 41 and the lower strap 43 in a position parallel to the upper and lower straps 41, 43. The upper and lower straps 41, 43 have an equal length and also have a length that is greater than a length of the center strap 45 to accommodate the greater diameter of the leg just above and below the knee. A length of a hook portion of a hook and loop fastener 47 is disposed proximal to an outer end 48 of each of the upper, lower, and center straps 41, 43, 45 and attaches to the outer side 48 of the support body 20 to assist securing the straps' 41, 43, 45 outer ends 48 to the support body 20 thereby not only adjusting the length of the straps 41, 43, 35, but also adjusting the tension of the attachment of the support body 20 to a user's knee.

A plurality of rings 49 is disposed on the right side 26 of the support body 20 in alignment with the respective upper, lower, and center straps 41, 43, 45 to permit the straps to engage the ring 49 for adjustment of a length of each of the straps 41, 43, 45.

An oval cutout 50 is centrally disposed in the support body 20. The oval cutout 50 is removably positioned over a user's knee cap 90 to accommodate the protruding bones of the knee cap 90 in order to avoid compression thereof.

A plurality of spaced apart vibrating motors 52 is disposed within the support body 20 on the inner side 30 thereof surrounding the oval cutout 50. The vibrating motors 52 include a first vibrating node 55 disposed between the oval cutout 50 and the top end 22. The vibrating motors also include a second vibrating node 57 disposed between the oval cutout 50 and one of the rings 49 centrally disposed on the right side 26, a third vibrating node 58 disposed between the oval cutout 50 and the bottom end 24, and a fourth vibrating node 59 disposed between the oval cutout 50 and the center strap 45.

An on-off pressure-switched rechargeable battery 60 is disposed on the outer side 32 of the support body 20 proximal the top end 22 for easier access thereto than were the battery 60 disposed on the inner side 30 or proximal the bottom end 24. The on-off pressure-switch feature of the rechargeable battery 60 permits the user to activate and alternately deactivate the rechargeable battery 60 and, in turn, the vibrating motors 52, with an amount of pressure thereon, thereby eliminating the need to flip a switch in a specific direction or turn a control button. This on-off pressure-switch feature is critical to the structure and functionality of the apparatus 10 to prevent the need for a user to bend over or to raise the user's knee to see a switch or button connected to the rechargeable battery 60. The rechargeable battery 60 is in operational communication with the vibrating motors 52 via wiring 61. A charge port 62 is disposed proximal the rechargeable battery 60 to permit the battery 60 to be recharged. A first pocket 64 is disposed on the outer side 32 of the support body 20. The first pocket 64 houses the rechargeable battery 60 and the charge port 62 and is sized to permit ample room for accessibility to the charge port 62 to recharge the rechargeable battery 60.

A plurality of second pockets 70 is disposed on the inner side 30 of the support body 20. Each second pocket 70 houses one of the vibrating motors 52. An interior lining 80 is continuously disposed on the inner side 30 of the support body 20 to prevent exposure to the wiring 61 while also providing a cool comfortable fit between the vibrating motors 52 and the user's knee when the support body is in place to massage a user's knee.

For the purposes of the description of the present apparatus, the terms "right side" and "left side" are interchangeable and not to be regarded as limiting. With respect to the above description then, it is to be realized that the optimum dimensional relationships for the parts of the therapeutic joint cover apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the therapeutic joint cover apparatus.

What is claimed is:

1. A stretchable therapeutic knee joint cover comprising:

elastomeric support cover for the knee joint to provide compression;

an interior lining of spandex;

vibrating motors, spaced apart within the lining electrically connected to a rechargeably battery and an on/off switch;

said knee joint cover being capable of simultaneously providing compression and vibration to the knee of a wearer of said knee cover.

2. The knee joint cover of claim 1 which has a first pocket disposed on its outer surface which accessibly retains the rechargeable battery and the charge port.

3. The knee joint cover of claim 2 wherein the on/off switch is a pressure switch.

4. The knee joint of claim 3 wherein the knee joint cover is formed of neoprene.

* * * * *